US011492188B2

(12) United States Patent
McGrath

(10) Patent No.: US 11,492,188 B2
(45) Date of Patent: Nov. 8, 2022

(54) COSMETIC-PRODUCT PACKAGING AND METHOD OF MANUFACTURING THEREOF

(71) Applicant: Pat McGrath Cosmetics LLC, New York, NY (US)

(72) Inventor: Patricia McGrath, New York, NY (US)

(73) Assignee: Pat McGrath Cosmetics LLC, New York, NY (US)

( * ) Notice: Subject to any disclaimer, the term of this patent is extended or adjusted under 35 U.S.C. 154(b) by 457 days.

(21) Appl. No.: 16/057,305

(22) Filed: Aug. 7, 2018

(65) Prior Publication Data

US 2020/0047965 A1 Feb. 13, 2020

(51) Int. Cl.

| | |
|---|---|
| ***B65D 77/04*** | (2006.01) |
| ***B65D 81/26*** | (2006.01) |
| ***B65D 43/22*** | (2006.01) |
| ***B65D 43/16*** | (2006.01) |
| ***A45D 34/00*** | (2006.01) |
| ***A45D 40/00*** | (2006.01) |
| ***B31B 50/26*** | (2017.01) |
| ***A45D 33/18*** | (2006.01) |

(52) U.S. Cl.

CPC ..... *B65D 77/0453* (2013.01); *A45D 33/18* (2013.01); *A45D 34/00* (2013.01); *A45D 40/00* (2013.01); *B31B 50/26* (2017.08); *B65D 43/163* (2013.01); *B65D 43/22* (2013.01); *B65D 81/264* (2013.01); *A45D 2034/007* (2013.01); *A45D 2040/0012* (2013.01)

(58) Field of Classification Search

CPC ..... B65D 21/00; B65D 21/02; B65D 5/50; B65D 5/48; B65D 5/48028; B65D 5/48034; B65D 5/503; B65D 5/38; B65D 77/0453; B65D 77/0446; B65D 77/042; B65D 77/0413; B65D 77/04

USPC ..... 220/23.87, 23.9, 23.91; 229/117.28

See application file for complete search history.

(56) References Cited

U.S. PATENT DOCUMENTS

| | | | | |
|---|---|---|---|---|
| 1,756,356 A * | 4/1930 | Hill | B65D 5/6611 | 24/127 |
| 2,104,828 A * | 1/1938 | Brinnon | B65D 5/48048 | 206/278 |
| 4,887,764 A * | 12/1989 | Ogura | B65D 5/0254 | 229/102 |
| 9,345,305 B2 * | 5/2016 | Sajuns | A45D 40/24 | |

* cited by examiner

*Primary Examiner* — Javier A Pagan

(74) *Attorney, Agent, or Firm* — Ziegler IP Law Group, LLC

(57) ABSTRACT

A cosmetic-product packaging, wherein the cosmetic-product packaging includes: an outer container, and a lid that is pivotally coupled to the outer container, wherein the outer container and the lid are provided with a first stud and a second stud respectively, wherein the studs are provided with respective flanges that are accessible externally to the cosmetic-product packaging, wherein a flexible cord is attached to at least one of the first and second studs and is wrappable under one or more flanges of the studs; an inner container that is mountable within the outer container, wherein, in operation, the inner container accommodates at least one cosmetics product, and the inner container is accommodated within the outer container; and the inner container is user-accessible when the lid is in an open position, wherein the cord is unwrapped.

13 Claims, 8 Drawing Sheets

COSMETIC-PRODUCT PACKAGING AND METHOD OF MANUFACTURING THEREOF

TECHNICAL FIELD

The present disclosure relates generally to product packaging; and more specifically, to a cosmetic-product packaging. Furthermore, the present disclosure also relates to a method of manufacturing a cosmetic-product packaging.

BACKGROUND

Cosmetic products for human beautification purposes are well known and have been used by humans for thousands of years. Notably, cosmetic products are bought by customers of cosmetic-product manufacturers. Such cosmetic products have more recently been provided to customers in various types of packaging (such as plastics-material packaging, paper packaging, fabric packaging, and the like) for providing cosmetic product protection en route from cosmetic-product manufactures to eventual customers. However, many customers, namely users, discard the cosmetic-product packaging after purchasing the cosmetic products. As a result, the discarded cosmetic-product packaging adds to waste within the environment.

More recently, there has been a growing concern about adapting human society to a more sustainable utilization of resources, such as more sustainable use if energy and materials, with an emphasis on reducing waste, and in particular, plastics-material waste. Notably, disposal of waste, such as plastics-material waste by way of dumping in ground or water bodies results in addition of plastics-material nanoparticles in soil and water bodies like rivers and oceans. Such addition of the plastics-material nanoparticles reduces fertility of soil and makes water unfit for drinking and other purposes. In addition, discarding cosmetic-product packaging made from paper, cardboards and the like, leads to unnecessary wastage of limited resources like wood. Therefore, recycling and re-use are important issues for sustainable utilization of resources which are used in making the cosmetic-product packaging.

Therefore, there arises a need for a cosmetic-product packaging that not only provides protection for a given cosmetic product from a given manufacturer to a given customer, but aesthetically appeals and is useful to the given customer, such that the given customer retains and cherishes the cosmetic-product packaging for long term use, rather than merely discarding the cosmetic-product packaging at an earliest opportunity.

SUMMARY

The present disclosure seeks to provide an improved cosmetic-product packaging. Moreover, the present disclosure seeks to provide at least a partial solution to an existing technical problem of wastage and improper waste management of packaging of cosmetic products. An aim of the present disclosure is to provide a solution that at least partially overcomes the aforesaid problems encountered in known art.

In one aspect, an embodiment of the present disclosure provides a cosmetic-product packaging, wherein the cosmetic-product packaging includes:

(i) an outer container, and a lid that is pivotally coupled to the outer container, wherein the outer container and the lid are provided with a first stud and a second stud respectively, wherein the studs are provided with respective flanges that are accessible externally to the cosmetic-product packaging, wherein a flexible cord is attached to at least one of the first and second studs and is wrappable under one or more flanges of the studs to secure the lid in a closed position to the outer container;

(ii) an inner container that is mountable within the outer container, wherein, in operation, the inner container accommodates at least one cosmetic product, and the inner container is accommodated within the outer container; and (iii) the inner container is user-accessible when the lid is in an open position, wherein the cord is unwrapped, for accessing the at least one cosmetic product.

Embodiments of the present disclosure substantially eliminate, or at least partially address, the aforementioned problems in the prior art and allow for an efficient, safe and user-friendly cosmetic-product packaging. The present disclosure provides for a substantial reduction in wastage of resources used in manufacturing the cosmetic-product packaging. Additionally, the present disclosure provides the cosmetic-product packaging that is reusable and recyclable.

Optionally, the cosmetic-product packaging is implemented such that that the outer container and inner container are fabricated from paper or cardboard-containing materials.

Optionally, the cosmetic-product packaging is implemented such that the outer container has an elongate rectilinear shape, wherein the outer container includes planar end panels at two ends of the outer container, and a plurality of planar side panels on sides of the outer container, and wherein the lid includes a plurality of planar lid panels that are mutually pivotally attached, wherein a first planar lid panel is pivotally attached along an elongate edge of one of the plurality of planar side panels of the outer container, and wherein a second planar lid panel is provided with the second stud, and one of the plurality of planar side panels of the outer container is provided with the first stud, such that the second planar lid panel is abutting in operation to at least one of the plurality of planar side panels of the outer container when the lid is in the closed position, and the first planar lid panel prevents access to the inner container when the lid is in the closed position.

Optionally, the cosmetic-product packaging is implemented, such that the plurality of planar side panels of the outer container surround the inner container on three lateral sides thereof.

Optionally, the cosmetic-product packaging is implemented, such that the outer container has an elongate length in a range 5 cm to 20 cm along an elongate axis of the outer container, and a lateral width in a range of 1 cm to 4 cm in a lateral axis of the outer container, wherein the elongate axis is orthogonal to the lateral axis.

Optionally, the cosmetic-product packaging is implemented, such that the flanges of the first and second studs have a diameter in a range of 10 mm to 25 mm.

Optionally, the cosmetic-product packaging is implemented such that the flanges are secured to the outer container and the lid by employing hollow metallic rivets with radially outwardly-directed end ridges that retain the flanges to the outer container and the lid.

Optionally, the cosmetic-product packaging is implemented, such that one or more planar panels of the outer container and the lid are fabricated as multi-layer structures.

Optionally, the cosmetic-product packaging is implemented, such that at least one of the planar panels of the outer container and the lid is secured by adhesive bonding.

Optionally, the cosmetic-product packaging is implemented, such that one or more external surfaces of the outer container and the lid have a wipe-clean surface coating.

Optionally, the cosmetic-product packaging is implemented, such that the studs are disposed in a range of 40% to 60% along an elongate length of the outer container and the lid.

Optionally, the cosmetic-product packaging is implemented, such that the inner container is fabricated from a porous material that, in operation, absorbs liquid spills or oozing from the at least one cosmetic product.

Optionally, the cosmetic-product packaging is implemented, such that the inner container is fabricated from corrugated cardboard.

Optionally, the cosmetic-product packaging is implemented, such that the inner container is of a rectilinear shape with planar side panels that abut to the planar side panels of the outer container, when the inner container is accommodated within the outer container.

Optionally, the cosmetic-product packaging is implemented, such that planar panels of the inner container completely surround the at least one cosmetic product when the inner container is accommodated within the outer container.

Optionally, the cosmetic-product packaging is implemented, such that one or more surfaces of the planar panels of the outer container are provided with a finish onto which graphical images are susceptible to being printed.

According to a second aspect, there is a provided a method of (for) manufacturing a cosmetic-product packaging, wherein the method includes:

(i) fabricating an outer container, and a lid that is pivotally coupled to the outer container, wherein the outer container and the lid are provided with a first stud and a second stud respectively, wherein the studs are provided with respective flanges that are accessible externally to the cosmetic-product packaging, wherein a flexible cord is attached to at least one of the first and second studs and is wrappable under one or more flanges of the studs to secure the lid in a closed position to the outer container;

(ii) fabricating an inner container that is mountable within the outer container, wherein, in operation, the inner container accommodates at least one cosmetics product, and the inner container is accommodated within the outer container; and (iii) arranging for the inner container to be user-accessible when the lid is in an open position, wherein the cord is unwrapped, for accessing the at least one cosmetics product.

Optionally, the method further comprises fabricating the outer container and inner container from paper- or cardboard-containing materials.

Optionally, the method further comprises fabricating the outer container to have an elongate rectilinear shape, wherein the outer container includes planar end panels at two ends of the outer container, and a plurality of planar side panels on sides of the outer container, and wherein the lid includes a plurality of planar lid panels that are mutually pivotally attached, wherein a first planar lid panel is pivotally attached along an elongate edge of one of the plurality of planar side panels of the outer container, and wherein a second planar lid panel is provided with the second stud, and one of the plurality of planar side panels of the outer container is provided with the first stud, such that the second planar lid panel is abutting in operation to at least one of the plurality of planar side panels of the outer container when the lid is in the closed position, and the first planar lid panel prevents access to the inner container when the lid is in the closed position.

Optionally, the method further comprises arranging for the plurality of planar side panels of the outer container to surround the inner container on three lateral sides thereof.

Optionally, the method further comprises fabricating the outer container to have an elongate length in a range 5 cm to 20 cm along an elongate axis of the outer container, and a lateral width in a range of 1 cm to 4 cm in a lateral axis of the outer container, wherein the elongate axis is orthogonal to the lateral axis.

Optionally, the method further comprises fabricating the flanges of the first and second studs to have a diameter in a range of 10 mm to 25 mm.

Optionally, the method further comprises securing the flanges to the outer container and the lid by employing hollow metallic rivets with radially outwardly-directed end ridges that retain the flanges to the outer container and the lid.

Optionally, the method further comprises fabricating one or more planar panels of the outer container and the lid as multi-layer structures.

Optionally, the method further comprises securing at least one of the planar panels of the outer container and its lid by adhesive bonding.

Optionally, the method further comprises fabricating one or more external surfaces of the outer container and the lid to have a wipe-clean surface coating.

Optionally, the method further comprises the method includes fabricating the studs to be disposed in a range of 40% to 60% along an elongate length of the outer container and the lid.

Optionally, the method further comprises fabricating the inner container from a porous material that, in operation, absorbs liquid spills or oozing from the at least one cosmetics product.

Optionally, the method further comprises fabricating the inner container from corrugated cardboard.

Optionally, the method further comprises fabricating the inner container to be of a rectilinear shape with planar side panels that abut to the planar side panels of the outer container, when the inner container is accommodated within the outer container.

Optionally, the method further comprises fabricating the cosmetic-product packaging such that planar panels of the inner container completely surround the at least one cosmetic product when the inner container is accommodated within the outer container.

Optionally, the method further comprises fabricating one or more surfaces of the planar panels of the outer container to be provided with a finish onto which graphical images are susceptible to being printed.

Additional aspects, advantages, features and objects of the present disclosure would be made apparent from the drawings and the detailed description of the illustrative embodiments construed in conjunction with the appended claims that follow.

It will be appreciated that features of the present disclosure are susceptible to being combined in various combinations without departing from the scope of the present disclosure as defined by the appended claims.

BRIEF DESCRIPTION OF THE DRAWINGS

The summary above, as well as the following detailed description of illustrative embodiments, is better understood when read in conjunction with the appended drawings. For the purpose of illustrating the present disclosure, exemplary constructions of the disclosure are shown in the drawings. However, the present disclosure is not limited to specific methods and instrumentalities disclosed herein. Moreover, those in the art will understand that the drawings are not to scale. Wherever possible, like elements have been indicated by identical numbers.

Embodiments of the present disclosure will now be described, by way of example only, with reference to the following diagrams wherein.

Figure 1:
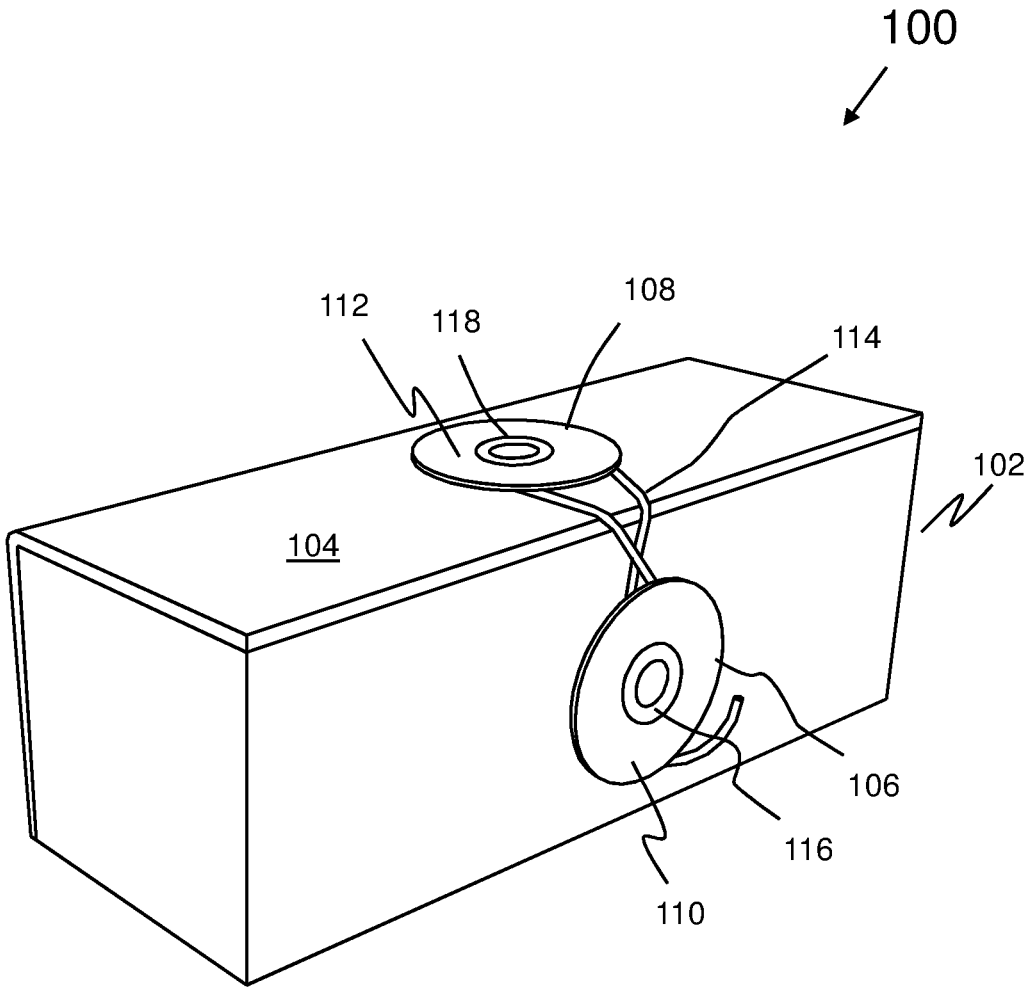
FIG. 1 is a schematic illustration of a perspective view of a cosmetic-product packaging in a closed state, in accordance with an embodiment of the present disclosure.

In the accompanying drawings, an underlined number is employed to represent an item over which the underlined number is positioned or an item to which the underlined number is adjacent. A non-underlined number relates to an item identified by a line linking the non-underlined number to the item. When a number is non-underlined and accompanied by an associated arrow, the non-underlined number is used to identify a general item at which the arrow is pointing.

DETAILED DESCRIPTION OF EMBODIMENTS

The following detailed description illustrates embodiments of the present disclosure and ways in which they can be implemented. Although some modes of carrying out the present disclosure have been disclosed, those skilled in the art would recognize that other embodiments for carrying out or practising the present disclosure are also possible.

In one aspect, there is provided a cosmetic-product packaging, wherein the cosmetic-product packaging includes:

(i) an outer container, and a lid that is pivotally coupled to the outer container, wherein the outer container and the lid are provided with a first stud and a second stud respectively, wherein the studs are provided with respective flanges that are accessible externally to the cosmetic-product packaging, wherein a flexible cord is attached to at least one of the first and second studs and is wrappable under one or more flanges of the studs to secure the lid in a closed position to the outer container;

(ii) an inner container that is mountable within the outer container, wherein, in operation, the inner container accommodates at least one cosmetics product, and the inner container is accommodated within the outer container; and (iii) the inner container is user-accessible when the lid is in an open position, wherein the cord is unwrapped, for accessing the at least one cosmetics product.

In another aspect, there is provided a method of (for) manufacturing a cosmetic-product packaging, wherein the method includes:

(i) fabricating an outer container, and a lid that is pivotally coupled to the outer container, wherein the outer container and the lid are provided with a first stud and a second stud respectively, wherein the studs are provided with respective flanges that are accessible externally to the cosmetic-product packaging, wherein a flexible cord is attached to at least one of the first and second studs and is wrappable under one or more flanges of the studs to secure the lid in a closed position to the outer container;

(ii) fabricating an inner container that is mountable within the outer container, wherein, in operation, the inner container accommodates at least one cosmetics product, and the inner container is accommodated within the outer container; and (iii) arranging for the inner container to be user-accessible when the lid is in an open position, wherein the cord is unwrapped, for accessing the at least one cosmetics product.

The present disclosure provides a cosmetic-product packaging that stores at least one cosmetic product. The cosmetic-product packaging disclosed herein is cost efficient, user friendly and easily accessible. Additionally, the cosmetic-product packaging provides an enhanced protection to the at least one cosmetic product stored therein. Notably, the cosmetic-product packaging substantially reduces a possibility of accidental damages caused to the at least one cosmetic product. The cosmetic-product packaging disclosed herein makes an optimized use of resources. Furthermore, the cosmetic-product packaging is reusable and recyclable. Therefore, the cosmetic-product packaging is environment friendly. It will be appreciated that, optionally, the cosmetic-product packaging is aesthetically appealing to users.

Throughout the present disclosure the term "cosmetic product" refers to a synthetic chemical and/or nature-based beauty product such as an eye liner, a lipstick, a kohl, a hand cream, a face mask, and the like, that is used by a user for beautification purposes. Generally, the user applies the at least one cosmetic product on himself/herself for improving his/her visual appearance. Typically, the at least one cosmetic product has a body which is in a form of a bottle, a sachet, a tube, a cylindrical container, and the like. The body of the at least one cosmetic product is made from materials like glass, plastic, fiber or any other material capable of containing the at least one cosmetic product within the body.

Furthermore, throughout the present disclosure, the term "cosmetic-product packaging" refers to an external packaging for the at least one cosmetic product. Generally, the at least one cosmetic product is arranged (namely, placed) within the cosmetic-product packaging for sale. Therefore, a shape and size of the cosmetic-product packaging is chosen according to a shape and size of the at least one cosmetic product. The cosmetic-product packaging has a three-dimensional geometrical shape, for example such as a cuboidal shape, a cubical shape, a cylindrical shape, a hexagonal prism shape, a pyramid shape, and the like. The cosmetic-product packaging is designed to be opened and closed for storing or accessing the at least one cosmetic product. In addition, the cosmetic-product packaging is made (namely fabricated, manufactured) from at least one material such as a plastics material, paper, glass, and the like. Moreover, a texture of the material used for fabricating the cosmetic-product packaging is rough, smooth, or any combination thereof; for example, some regions of the cosmetic-product packaging is rough, wherein other regions of the cosmetic-product packing is smooth. For example, by "smooth" is meant a surface undulation of less than X mm, and by "rough" is meant a surface undulation of more than X mm, wherein X is in a range of 0.05 mm to 0.25 mm, more optionally wherein X is in a range of 0.08 mm to 0.15 mm. In addition, a finish of the cosmetic-product packaging could be uncoated, glossy, matte, and the like.

Beneficially, the cosmetic-product packaging provides protection to the at least one cosmetic product therein. Notably, the cosmetic-product packaging protects the cosmetic product from any damage caused by physical impacts (for example, such as falls, crushing, rough handling, friction with surfaces or other objects, and the like) and any other accidental factors (such as heat damage, spillage damage, and the like).

The cosmetic-product packaging includes the outer container. Notably, the outer container provides a definite shape and structure to the cosmetic-product packaging. In addition, since the outer container is the outermost element of the cosmetic-product packaging, the outer container is generally designed in a manner that provides an aesthetic appeal to the cosmetic-product packaging. Optionally, dimensions of the outer container are greater than dimensions of the at least one cosmetic product that is to be stored within the outer container. Beneficially, the outer container serves as an outermost element of the cosmetic-product packaging that is exposed to the environment, whilst securing the at least one cosmetic product therein and therefore, provides protection to the at least one cosmetic product.

The cosmetic-product packaging includes the lid that is pivotally coupled to the outer container. The lid serves as a covering that is coupled to the outer container along an edge of the outer container in a manner that the lid can be pivotally moved to cover an open side of the outer container for completely enclosing the at least one cosmetic product within the cosmetic-product packaging. In other words, the pivotal coupling between the outer container and the lid allows for turning of the lid along the edge of the outer container and the lid in order to close or open the cosmetic-product packaging.

In an embodiment, the lid is pivotally coupled to the outer container along an entire length of a given edge of the outer container. In another embodiment, the lid is pivotally coupled to the outer container along only a portion of an entire length of the given edge of the outer container. In such a case, the lid can be pivotally coupled to the outer container along only a central portion or a side portion of the entire length of the given edge of the outer container.

The outer container and the lid are provided with the first stud and the second stud respectively. Notably, the first stud is positioned on an external surface of the outer container and the second stud is positioned on an external surface of the lid in a manner that the first and second studs are accessible to the user. The first stud and the second stud are three dimensional structures that are provided on the outer container and the lid respectively, for purposes of fastening and unfastening the outer container and the lid. Notably, the first stud and the second stud could have a circular shape, a polygonal shape, an elliptical shape, an abstract shape, a specific shape (for example, such as a crown shape, a jewel shape), and the like.

For sake of simplicity and clarity, "the first stud and the second stud" are collectively referred to as "the studs" or "the first and the second studs" throughout the description.

Optionally, the first stud and the second stud are mutually identical. In such a case, a shape and/or a size of the first stud and the second stud is substantially mutually identical; for example, by "substantially" is meant identical to within +/−20% in physical dimensions, more optionally to within +/−5% in physical dimensions. Alternatively, optionally, the first stud and the second stud are non-identical. In such a case, the shape and/or the size of the first stud and the second stud are mutually different; for example, by "different" is meant more than +/−5% different from each other in physical dimensions, more optionally more than +/−20% different from each other in physical dimensions.

Optionally, the studs are disposed in a range of 40% to 60% along the elongate length of the outer container and the lid. In other words, the studs can be disposed within a region that lies between 40%, to 60% of the elongate length of the outer container and the lid. Therefore, the studs are disposed in a substantially central region of the outer container and the lid. It will be appreciated that such positioning of the first and second studs allows for securely closing the cosmetic-product packaging from its centre. In an embodiment, both of the studs are disposed at a substantially similar distance along the elongate length of the outer container and the lid. For example, the first and the second studs may be positioned at a 50% length along the elongate length of the outer container and the lid. In other words, the first and second studs may be positioned at centers of the outer container and the lid. In another example, both the studs are disposed at different distances along the elongate length of the outer container and the lid. For example, the first stud is positioned at 40% along the elongate length of the outer container and the second stud is positioned at 60% along the elongate length of the lid. In such an example, the first and second studs are positioned diagonally with respect to each other.

The studs are provided with respective flanges that are accessible externally to the cosmetic-product packaging, wherein the flexible cord is attached to at least one of the first and second studs and is wrappable under one or more flanges of the studs to secure the lid in a closed position to the outer container. Notably, the flanges of the studs act as a projecting part of the studs, and allow for attaching one stud to another. Specifically, the flanges can be projecting rims, collars, ribs and the like. The flanges of the studs could have a circular shape, a polygonal shape, an elliptical shape, an abstract shape, and the like. Beneficially, the flanges act as supporting structures of the studs. As an example, the studs are provided with flat, circular flanges.

Optionally, the flanges of the first and second studs have a diameter in a range of 10 mm to 25 mm. In such a case, the flanges of the first and second studs are circular in shape. Notably, for example, the flanges of the first and second studs could have the diameter equal to 10, 11, 12, 13, 14, 15, 16, 17, 18, 19, 20, 21, 22, 23, 24 or 25 mm. Notably, the diameter of the flanges of the first and second studs corresponds to dimensions of the first and second studs. It will be appreciated that the diameter of the flanges of the first and second studs is selected to be such that the first and second studs are adequately visible to the user, and do not obscure a substantial portion of the external surface of the outer container, for example the flanges have an area that is less than 25% of the external surface of the outer container.

Alternatively, optionally, the flanges of the first and second studs have a diameter that is lesser than 10 mm or greater than 25 mm.

According to an embodiment, diameters of the flanges of the first and second studs are mutually equal. For example, the flanges of the first and the second studs may have a diameter equal to 14 mm. According to an embodiment, the diameters of the flanges of the first and second studs are mutually unequal. For example, the flange of the first stud may have a diameter equal to 16 mm and the flange of the second stud may have a diameter equal to 12 mm.

Optionally, the flanges are secured to the outer container and the lid by employing hollow metallic rivets with radially outwardly-directed end ridges that retain the flanges to the outer container and the lid. In such a case, the outer container and the lid have holes corresponding to the radially outwardly-directed end ridges of the rivets, to allow for the rivets to engage securely the flanges with the outer container and the lid. Such hollow metallic rivets also provide an added visual appeal to the outer container and the lid, for example when the rivets have a brass-like external appearance.

Notably, the flexible cord is an elongate thread-like (or string-like structure) having flexible (namely, stretchy) properties that allow for the flexible cord to be snugly fitted about the studs for interconnecting the studs, as well as to be easily removable for disconnecting the studs. Notably, the flexible cord is made of a flexible material. In other words, the material used for making the flexible cord is optionally stretchy (namely, capable of being stretched). Examples of such flexible materials include, but are not limited to, neoprene, rubber and the like.

For sake of simplicity and clarity, "the flexible cord" is collectively referred to as "the cord" throughout the description.

In use, the flexible cord can be wrapped by the user under the one or more flanges of the studs for tying the studs to secure the lid in the closed position to the outer container. In such a closed position, the at least one cosmetic product is prevented from falling out of the cosmetic-product packaging or being accessed by the user. Furthermore, in use, the flexible cord can also be unwrapped by the user, from under the one or more flanges of the studs, thereby untying the studs to pivot the lid away from the outer container into the open position. In the open position, the at least one cosmetic product can be accessed by the user, and can also fall out of the cosmetic-product packaging if the cosmetic-product packaging is not handled properly by its user.

According to an embodiment, the flexible cord is permanently attached to only one of the studs. In such a case, a loose end of the flexible cord which is not attached to any stud, can be wrapped under the one or more flanges of the remaining stud for securing the lid in the closed position to the outer container. For opening the lid, the same loose end can be unwrapped from under the one or more flanges of the remaining stud (to which the flexible cord is not attached) to disentangle the studs.

According to another embodiment, the flexible cord is permanently attached to both the first and the second studs. In such a case, the flexible cord can be inherently wrapped under the one or more flanges of the studs for securing the lid in the closed position to the outer container. For opening the lid, the flexible cord can be stretched in a manner that it allows the lid to be moved pivotally away from the outer container to the open position.

According to yet another embodiment, the flexible cord is temporarily attached to the studs. In such a case, the flexible cord could be in a form of a flexible string or a flexible loop that that is separate from the cosmetic-product packaging, and can be wrapped under the one or more flanges of the studs to secure the lid in the closed position to the outer container. Such a flexible cord could then also be unwrapped entirely from under the one or more flanges of the studs to disentangle the studs. Such an arrangement is of advantage in that, should the cord break in use, it can be very easily replaced without disturbing the rivets of the studs.

Furthermore, the cosmetic-product packaging includes the inner container that is mountable within the outer container, wherein, in operation, the inner container accommodates the at least one cosmetic product, and the inner container is accommodated within the outer container. Notably, the inner container has a size which is smaller than the outer container, in order to be accommodated within the outer container. The inner container can be positioned within the outer container in a way that the inner container is substantially surrounded by the outer container. It will be appreciated that the size of the inner container is greater than a size of the at least one cosmetic product to be accommodated therein, in order to provide adequate room for the at least one cosmetic product within the cosmetic-product packaging.

The inner container is user-accessible when the lid is in the open position, wherein the cord is unwrapped, for accessing the at least one cosmetic product. When the cord is unwrapped, the lid can be pivotally turned away from the outer container in a manner that the inner container becomes accessible to the user. In simpler terms, the lid can be understood to act as covering which, in the closed position, makes the inner container inaccessible to the user, and in the open position, makes the inner container accessible to the user. Notably, the inner container cannot be accessed without pivotally moving the lid away from the outer container into the open position. In other words, when the lid is secured in the closed position to the outer container, the inner container which is placed within the outer container becomes inaccessible to the user.

Optionally, the outer container and inner container are fabricated from paper or cardboard-containing materials. Notably, the paper or cardboard-containing materials are lightweight, easy to handle and inexpensive. Beneficially, such paper or cardboard-containing materials can be easily reused and/or recycled, and are therefore extremely environment friendly. Optionally, the outer container and/or the inner container are fabricated from a combination of the paper or cardboard-containing materials.

Optionally, the inner container is fabricated from a porous material that, in operation, absorbs liquid spills or oozing from the at least one cosmetic product. Generally, the body of the at least one cosmetic product contains the at least one cosmetic product therein to avoid any undesirable spillage. However, in an unfortunate scenario of spillage or oozing of the at least one cosmetic product, such an absorbent inner container comes in handy to protect the outer container from liquid damage or spotting. Notably, the porous material used in fabricating the inner container is a cellulosic or a fiber-based product, such as tissue paper, cotton, sponge and fluff pulp.

Optionally, the inner container is fabricated from corrugated cardboard. Notably, the corrugated cardboard is a corrugated sheet of stiff paper lined by one or more linerboards. Beneficially, the corrugated cardboard has higher absorbency and a higher strength as compared to regular cardboards and paper. Therefore, the inner container fabricated from corrugated cardboard absorbs undesirable liquid spills or oozing from the at least one product whilst also providing protection from physical damages (for example, damage caused by accidental crushing, falling and the like).

Optionally, one or more inner surfaces of the inner container are lined with shock absorbing material to protect the at least one cosmetic product arranged within the inner container. Examples of such shock absorbing material include, but are not limited to, foam, cloth, soft plastics materials, gel liners and silicone (for example, biodegradable silicone).

Optionally, one or more external surfaces of the outer container and the lid have a wipe-clean surface coating. Such one or more external surfaces having the wipe-clean surface coating could be wiped clean by way of dry cleaning techniques or wet cleaning techniques. In the dry cleaning techniques, the user may clean the one or more external surfaces of the outer container and the lid using a dry material (such as a dry napkin or a dry tissue) whereas, in the wet cleaning techniques, the user may clean the one or more external surfaces of the outer container and the lid using rub a damp material (such as a damp napkin or a damp cloth) or a wet material (such as a cleaning spray). More optionally, the wipe-clean surface coating acts as a water-proof coating to allow for cleaning the one or more external surfaces of the outer container and the lid by way of the wet cleaning techniques. In an example, the one or more external surfaces of the outer container and the lid can have a wax coating thereon. Beneficially, the wax coating at least partially prevents water drops to be absorbed within such surfaces. In another example, the one or more external surfaces of the outer container and the lid can have a plastics-material coating thereon that allows the user to wipe such surfaces with a wet cleaning material.

Optionally, the outer container has an elongate rectilinear shape, wherein the outer container includes planar end panels at two ends of the outer container, and a plurality of planar side panels on sides of the outer container, and wherein the lid includes a plurality of planar lid panels that are mutually pivotally attached, wherein a first planar lid panel is pivotally attached along an elongate edge of one of the plurality of planar side panels of the outer container, and wherein a second planar lid panel is provided with the second stud, and one of the plurality of planar side panels of the outer container is provided with the first stud, such that the second planar lid panel is abutting in operation to at least one of the plurality of planar side panels of the outer container when the lid is in the closed position, and the first planar lid panel prevents access to the inner container when the lid is in the closed position. Optionally, the elongate rectilinear shape is one of: a cubical shape, a cuboidal shape. Optionally, a number of the planar side panels is chosen such that the inner container can be accessed from at least one side of the outer container. Notably, a given planar lid panel is pivotally attached to one or more planar lid panels adjacent thereto. Such pivotal attachment of the plurality of planar lid panels allows for pivotally turning the lid with respect to the outer container in a plane-by-plane manner. Furthermore, for a given planar lid panel that abuts a given planar side panel of the outer container, dimensions of the given planar lid panel substantially correspond to dimensions of the given planar side panel. The first planar lid panel can be turned to abut with a planar side panel including the elongate edge (of pivotal attachment between the lid and the outer container), when the lid is in the closed position. In such a scenario, the first planar lid panel covers an open side of the outer container, thereby preventing access to the inner container. Furthermore, in such a closed position of the lid, the second planar lid panel abuts at least one of the plurality of planar side panels of the outer container. As an example, in the closed position of the lid, the second planar lid panel may abut only one planar side panel from among the plurality of planar side panels of the outer container. The second planar lid panel abuts in operation to at least one of the plurality of planar side panels of the outer container when the lid is in the closed position, in a manner that the second stud of the second planar lid panel is adjacent to a planar side panel (of the outer container) that is provided with the first stud. Notably, when the lid is in the closed position, the second planar lid panel covers at least one planar side panel from among the plurality of planar side panels of the outer container.

Optionally, the second stud is arranged at a center of the second planar lid panel or towards an edge of the second planar lid panel. Similarly, optionally, the first stud is arranged at a center of its corresponding planar side panel or towards an edge of its corresponding planar side panel.

Optionally, the plurality of planar side panels of the outer container surround the inner container on three lateral sides thereof. In such an example, the outer container includes three planar side panels, one corresponding to each side of the inner container. As a result, the inner container is completely housed within the outer container, and can be accessed from only one open side of the outer container. Beneficially, such a multi-layered structure provided by the outer container surrounding the inner container provides ample protection to the cosmetic product stored within the cosmetic product packaging.

Optionally, the plurality of planar side panels of the outer container fit snugly around the three lateral sides of the inner container. As a result, no adhesive material is required to secure the inner container within the outer container. Alternatively, optionally, at least one planar side panel from among the plurality of planar side panels of the outer container is adhesively secured to a corresponding lateral side of the inner container.

Furthermore, optionally, the outer container has an elongate length in a range of 5 cm to 20 cm along an elongate axis of the outer container, and a lateral width in a range of 1 cm to 4 cm in a lateral axis of the outer container, wherein the elongate axis is orthogonal to the lateral axis. Notably, the elongate axis runs along a length of the cosmetic-product packaging and the lateral axis of the cosmetic-product runs along a width of the cosmetic-product packaging. Notably, the plurality of planar side panels are arranged along the elongate axis of the outer container whereas the planar end panels are arranged along the lateral axis of the outer container. Therefore, the elongate length of the outer container substantially corresponds to an elongate dimension of the planar side panels of the outer container. Similarly, the lateral width of the outer container substantially corresponds to a lateral dimension of the planar end panels.

In an example, the elongate length of the outer container may be, for example, 5, 6, 7, 8, 9, 10, 11, 12, 13, 14, 15, 16, 17, 18, 19 or 20 cm, whereas the lateral width of the outer container may be, for example, 1, 1.5, 2, 2.5, 3, 3.5 or 4, cm.

Optionally, one or more planar panels of the outer container and the lid are fabricated as multi-layer structures. Notably, fabrication of the one or more planar panels as multi-layer structures relates to manufacturing (namely, creating) the one or more planar panels in a manner wherein multiple layers of material are arranged to form the one or more planar panels. Such multiple layers of a given multi-layered planar panel are fabricated by at least one of: adhesively bonding the multiple layers to one another, folding a single material into the multiple layers, stacking the multiple layers one on top of the other. Beneficially, such a multi-layer structure of the one or more planar panels of the outer container and the lid provide strength and rigidity to the cosmetic-product packaging. Furthermore, the multi-layer structure also provides protection to the at least one cosmetic product against damages like falling, spilling of water, scratches and the like. In an example, the multi-layer structure of a given planar panel may be fabricated by adhesively bonding in a range of 2 to 6 layers, more optionally 4 layers, of paper and/or plastics-material sheets. In another example, the multi-layer structure of a given planar panel may be fabricated by folding pieces of paper, plastics-material or any other suitable material.

Optionally, at least one of the planar panels of the outer container and its lid is secured by adhesive bonding. Such adhesively-bonded planar panels of the outer container and the lid are stronger and more rigid as compared to other unbonded planar panels of the outer container and the lid. Optionally, planar panels of the outer container and the lid that correspond to a bottom side of the cosmetic-product packaging are secured by the adhesive bonding. This would allow the bottom side of the cosmetic product to be able to bear weight of the at least one cosmetic product contained within the cosmetic-product packaging. Optionally, the at least one of the planar panels of the outer container and the lid is secured by way of at least one of: pins, rivets, clamps.

Optionally, at least one of the planar panels of the outer container and its lid are secured by magnetic bonding.

Optionally, the inner container is of a rectilinear shape with planar side panels that abut to the planar side panels of the outer container, when the inner container is accommodated within the outer container. In this regard, such a rectilinear shape substantially corresponds to the elongate rectilinear shape of the outer container and is optionally one of: a cubical shape, a cuboidal shape. As a result, optionally, the planar side panels of the inner container are arranged at right angles (namely orthogonal) with respect to each other and the end planar side panels, thereby forming the rectilinear shape of the inner container and abutting the planar side panels of the outer container. Notably, a number of planar side panels of the inner container is selected such that one side of the inner container is open to allow the user to access the at least one cosmetic product. Specifically, the planar side panels of the inner container form a storage compartment for accommodating the at least one cosmetic product therein. It will be appreciated that the open side of the inner container is covered by the lid (and optionally, the second planar lid panel) when the lid is in the closed position.

Optionally, the planar side panels of the inner container completely surround the at least one cosmetic product when the inner container is accommodated within the outer container. The inner container is designed in a way to accommodate fully the at least one cosmetic product within a three-dimensional space between the planar side panels of the inner container. As a result, no part of the body of the at least one cosmetic product lies outside of the inner container and is carefully protected within the cosmetic-product packaging.

Optionally, the inner container comprises at least one internal dividing panel arranged to divide a space within the inner container in a manner that two or more cosmetic products are accommodated within the inner container. Optionally, a size of the at least one internal dividing panel is selected based upon sizes of the two or more cosmetics products that are to be accommodated within the inner container. Optionally, an arrangement of the at least one internal dividing panel within the inner container is based upon a desired arrangement of the two or more cosmetic products. In an example, the inner container may be divided by way of one internal dividing panel into two compartments along an elongate axis of the inner container. In such an example, two cosmetic products may be housed within the inner container wherein such cosmetic products are in a tubular form or in a form of sticks. In another example, the inner container may be divided by way of two internal dividing panels, one internal dividing panel being arranged along the elongate axis of the inner container and another internal dividing panel being arranged along a lateral axis of the inner container. In such an example, four cosmetic products may be arranged within the inner container, such cosmetic products being in a form of small bottles: by "small" is meant having a cross-section diameter of less than 2 cm, more optionally less than 1 cm.

Optionally, one or more surfaces of the planar panels of the outer container are provided with a finish onto which graphical images are susceptible to being printed. In such a case, one or more internal surfaces and/or external surfaces, for example a plurality of such surfaces, of the one or more surfaces of the planer panels of the outer container are provided with the finish. Such a finish could be a glossy finish, a matte finish, and the like. Notably, printing the graphical images on the one or more surfaces of the planar panels of the outer container allows for enhancing a visual appearance of the cosmetic-product packaging. Furthermore, such graphical images can also be employed to convey information to potential buyers and users of the at least one cosmetic product enclosed within the cosmetic-product packaging; for example, the information pertains to instructions regarding a manner of use of the at least one cosmetic product (for example, allergy information). Examples of such graphic images include, but are not limited to, a brand name of the manufacturer of the at least one cosmetic product, a logo of the manufacturer of the at least one cosmetic product, a shade of the at least one cosmetic product, a collection to which the at least one cosmetic product belongs, a price of the at least one cosmetics product, an expiry date of the at least one cosmetic product, direction of use of the at least one cosmetics product, an image, an abstract design, a pattern, text, and numeric characters. In an example, all outer surfaces of the planar panels of the outer container may be provided with a glossy finish and the brand name of the manufacturer of the at least one cosmetic product and the shade of the at least one cosmetics product may be printed onto such outer surfaces.

The present disclosure also relates to the method as described above. Various embodiments and variants disclosed above apply mutatis mutandis to the method.

Optionally, the method further includes fabricating the outer container and inner container from paper- or cardboard-containing materials.

More optionally, the method further includes fabricating the outer container to have an elongate rectilinear shape, wherein the outer container includes planar end panels at two ends of the outer container, and a plurality of planar side panels on sides of the outer container, and wherein the lid includes a plurality of planar lid panels that are mutually pivotally attached, wherein a first planar lid panel is pivotally attached along an elongate edge of one of the plurality of planar side panels of the outer container, and wherein a second planar lid panel is provided with the second stud, and one of the plurality of planar side panels of the outer container is provided with the first stud, such that the second planar lid panel is abutting in operation to at least one of the plurality of planar side panels of the outer container when the lid is in the closed position, and the first planar lid panel prevents access to the inner container when the lid is in the closed position.

Furthermore, optionally, the method further includes arranging for the plurality of planar side panels of the outer container to surround the inner container on three lateral sides thereof.

Optionally, the method further includes fabricating the outer container to have an elongate length in a range of 5 cm to 20 cm along an elongate axis of the outer container, and a lateral width in a range of 1 cm to 4 cm in a lateral axis of the outer container, wherein the elongate axis is orthogonal to the lateral axis.

More optionally, the method further includes fabricating the flanges of the first and second studs to have a diameter in a range of 10 mm to 25 mm.

Furthermore, optionally, the method further includes securing the flanges to the outer container and the lid by employing hollow metallic rivets with radially outwardly-directed end ridges that retain the flanges to the outer container and the lid. Optionally, the hollow metallic rivets are fabricated from a brass alloy.

Optionally, the method further includes fabricating one or more planar panels of the outer container and the lid as multi-layer structures.

More optionally, the method further includes securing at least one of the planar panels of the outer container and its lid by adhesive bonding.

Furthermore, optionally, the method further includes fabricating one or more external surfaces of the outer container and the lid to have a wipe-clean surface coating.

Optionally, the method further includes fabricating the studs to be disposed in a range of 40% to 60% along an elongate length of the outer container and the lid.

More optionally, the method further includes fabricating the inner container from a porous material that, in operation, absorbs liquid spills or oozing from the at least one cosmetics product.

Furthermore, optionally, the method further includes fabricating the inner container from corrugated cardboard.

Optionally, the method further includes fabricating the inner container to be of a rectilinear shape with planar side panels that abut to the planar side panels of the outer container, when the inner container is accommodated within the outer container.

More optionally, the method further includes fabricating the cosmetic-product packaging such that planar panels of the inner container completely surround the at least one cosmetic product when the inner container is accommodated within the outer container.

Furthermore, optionally, the method further includes fabricating one or more surfaces of the planar panels of the outer container to be provided with a finish onto which graphical images are susceptible to being printed.

DETAILED DESCRIPTION OF THE DRAWINGS

Referring to FIG. 1, there is shown a schematic illustration of a perspective view of a cosmetic-product packaging 100 in a closed state, in accordance with an embodiment of the present disclosure. The cosmetic-product packaging 100 includes an outer container 102, and a lid 104 that is pivotally coupled to the outer container 102. In addition, the outer container 102 and the lid 104 are provided with a first stud 106 and a second stud 108 respectively. Furthermore, the studs 106 and 108 are provided with respective flanges 110 and 112 that are accessible externally to the cosmetic-product packaging 100. Moreover, a flexible cord 114 is attached to at least one of the first 106 and second 108 studs and is wrappable under one or more flanges 110 and 112 of the studs 106 and 108 to secure the lid 104 in a closed position to the outer container 102. Furthermore, an inner container (shown in FIG. 3) is mountable within the outer container 102. Notably, the inner container accommodates at least one cosmetic product (not shown), and the inner container is accommodated within the outer container 102. Additionally, the inner container is user-accessible when the lid 104 is in an open position, wherein the cord 114 is unwrapped, for accessing the at least one cosmetic product (not shown). Additionally, the one or more flanges 110 and 112 are optionally secured to the outer container 102 and the lid 104 by employing hollow metallic rivets 116 and 118 respectively with radially outwardly-directed end ridges that retain the flanges 110 and 112 to the outer container 102 and the lid 104. Optionally, the hollow metallic rivets 116 and 118 are fabricated from a brass alloy, or a brass-plated steel alloy.

Figure 2:
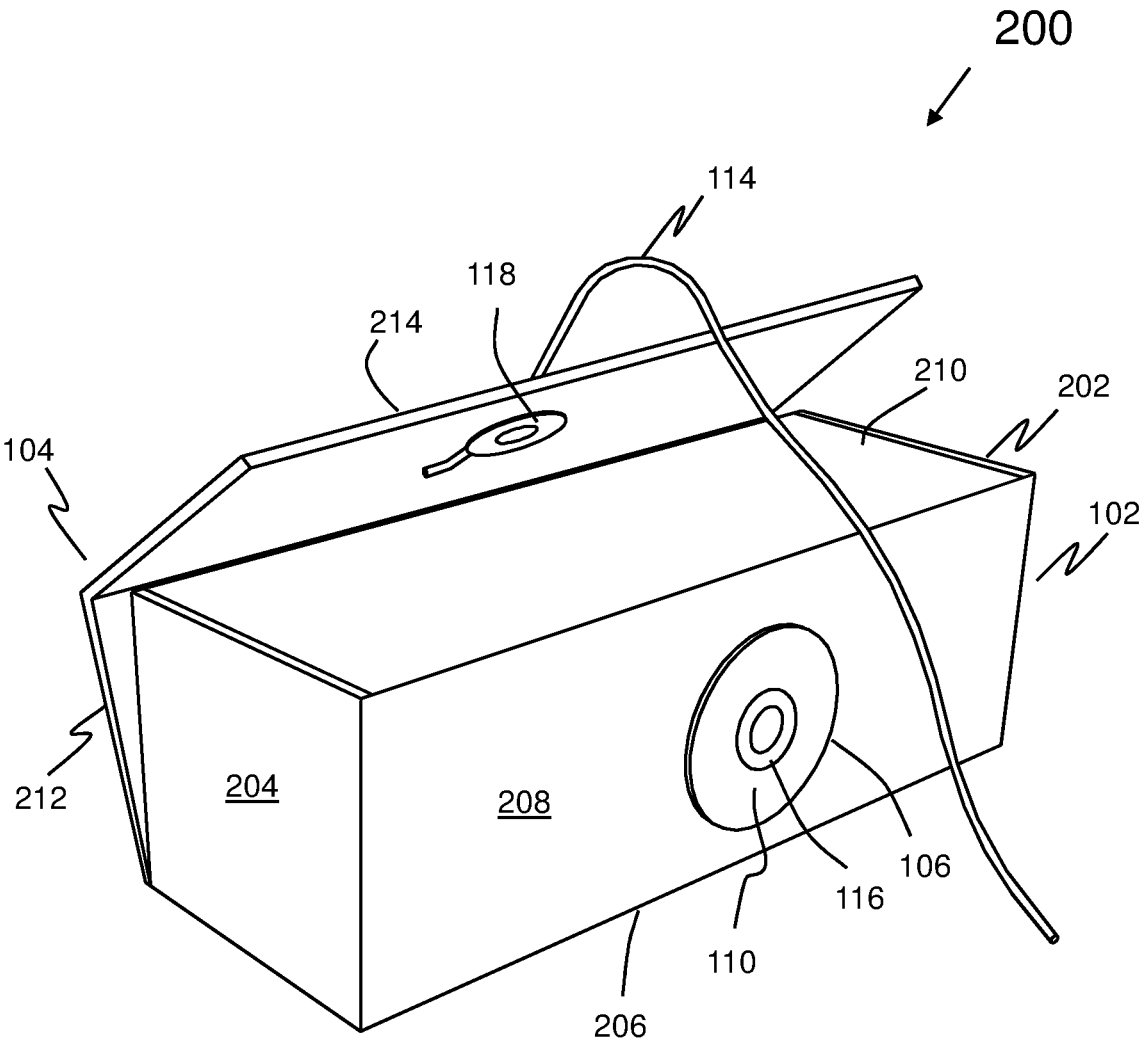
FIG. 2 is a schematic illustration of a perspective view of a cosmetic-product packaging such as the cosmetic-product of FIG. 1 in a partly open state, in accordance with an embodiment of the present disclosure.

Referring to FIG. 2, there is shown a schematic illustration of a perspective view of a cosmetic-product packaging (such as the cosmetic-product 100 of FIG. 1) in a partly open state, in accordance with an embodiment of the present disclosure. The outer container 102 includes planar end panels 202 and 204 at two ends of the outer container 102, and a plurality of planar side panels 206, 208 and 210 on sides of the outer container 102, and wherein the lid 104 includes a plurality of planar lid panels that are mutually pivotally attached, wherein a first planar lid panel 212 is pivotally attached along an elongate edge of one of the plurality of planar side panels 206 of the outer container, and wherein a second planar lid panel 214 (for example, wherein the second planar lid panel 214 is a distal planar lid panel of the lid 104) is provided with the second stud (as shown in FIG. 1), and one of the plurality of planar side panels of the outer container is provided with the first stud 106, such that the second planar lid panel 214 is abutting in operation to at least one of the plurality of planar side panels 210 of the outer container 102 when the lid 104 is in the closed position, and the first planar lid panel 212 prevents access to the inner container (shown in FIG. 3) when the lid 104 is in the closed position.

Figure 3:
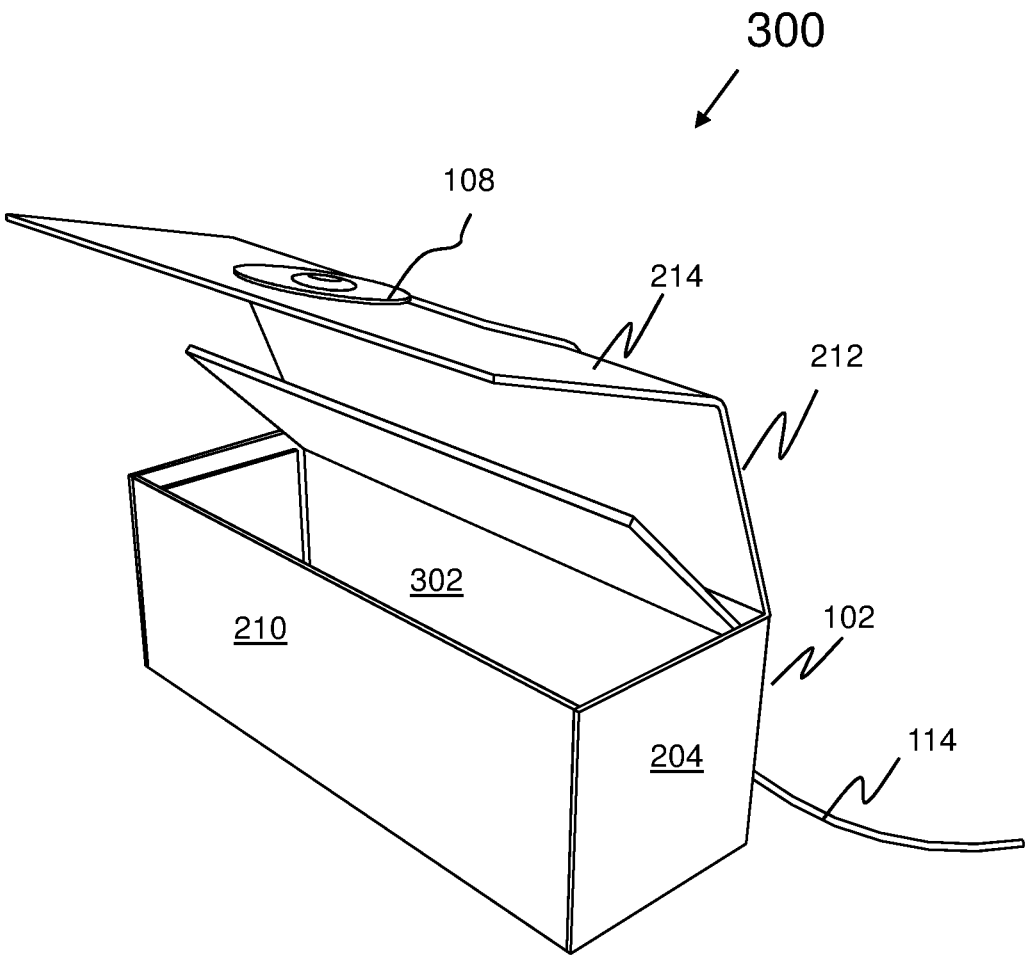
FIG. 3 is a schematic illustration of a top view of a cosmetic-product packaging such as the cosmetic-product of FIG. 1 in an open state, in accordance with an embodiment of the present disclosure.

Referring to FIG. 3, there is shown a schematic illustration of a perspective view of a cosmetic-product packaging (such as the cosmetic-product packaging 100 of FIG. 1) in an open state, in accordance with an embodiment of the present disclosure. Notably, the outer container 102 accommodates the inner container 302. The inner container 302 can be accessed by unwrapping the cord 114 and turning the first planar lid panel 212 and the second planar lid panel 214 relative to the plurality of planar side panels 210 of the outer container 102.

Figure 4:
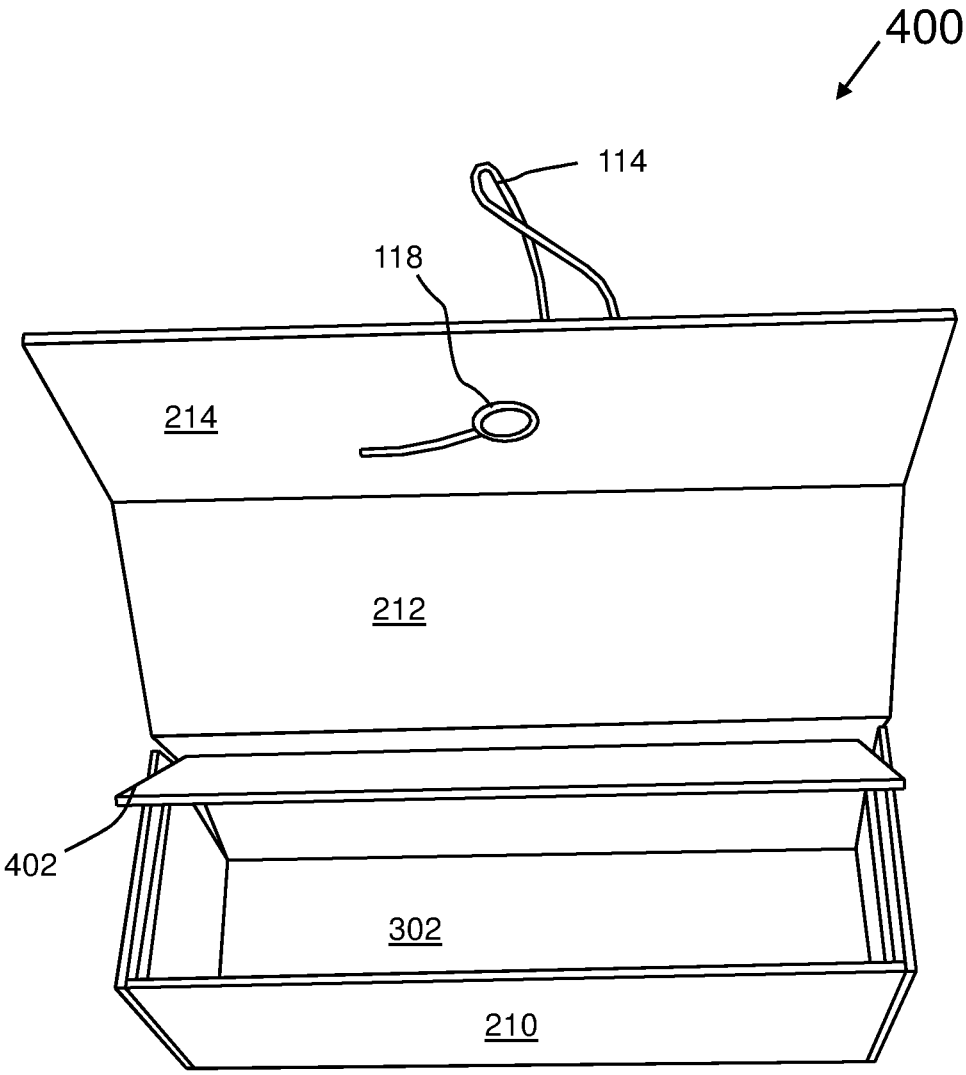
FIG. 4 is a schematic illustration of a top view of a cosmetic-product packaging such as the cosmetic-product of FIG. 1 in an open state, in accordance with an embodiment of the present disclosure.

Referring to FIG. 4, there is shown a schematic illustration of a top view of a cosmetic-product packaging (such as the cosmetic-product packaging 100 of FIG. 1) in an open state, in accordance with an embodiment of the present disclosure. The inner container 302 is accessed for accessing a cosmetic product (not shown) stored therein. The inner container 302 has an optional lid 402 that covers (namely is configured to cover) the inner container from a top thereof.

Figure 5:
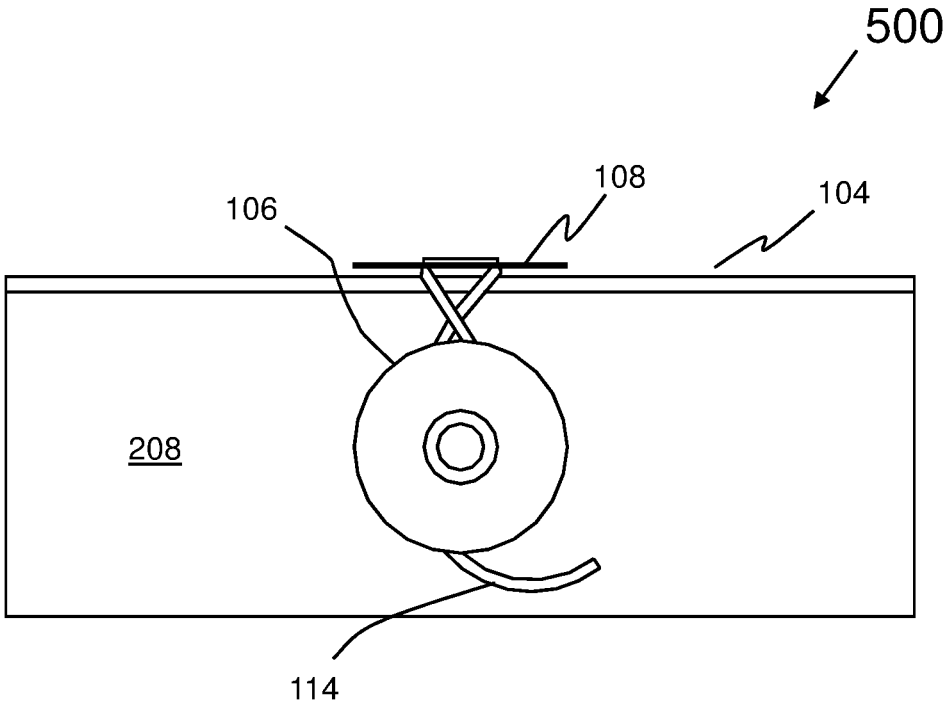
FIG. 5 is a schematic illustration of a front view of a cosmetic-product packaging such as the cosmetic-product of FIG. 1 in a closed state, in accordance with an embodiment of the present disclosure.

Referring to FIG. 5, there is shown a schematic illustration of a front view of a cosmetic-product packaging (such as the cosmetic-product packaging 100 of FIG. 1) in a closed state, in accordance with an embodiment of the present disclosure. The cord 114 is wrapped around the first stud 106 and the second stud 108. Therefore, the cosmetic-product packaging is closed.

Figure 6:
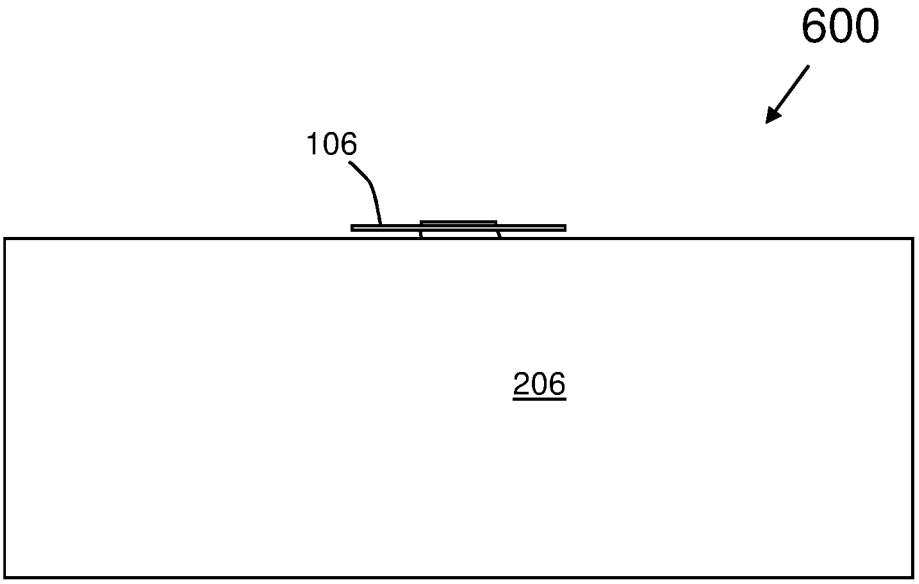
FIG. 6 is a schematic illustration of a bottom view of a cosmetic-product packaging such as the cosmetic-product of FIG. 1 in a closed state, in accordance with an embodiment of the present disclosure.

Referring to FIG. 6, there is shown a schematic illustration of a bottom view of a cosmetic-product packaging (such as the cosmetic-product packaging 100 of FIG. 1) in a closed state, in accordance with an embodiment of the present disclosure. The one of the plurality of planar side panels 206 of the outer container forms a base of the cosmetic-product packaging in the closed state.

Figure 7:
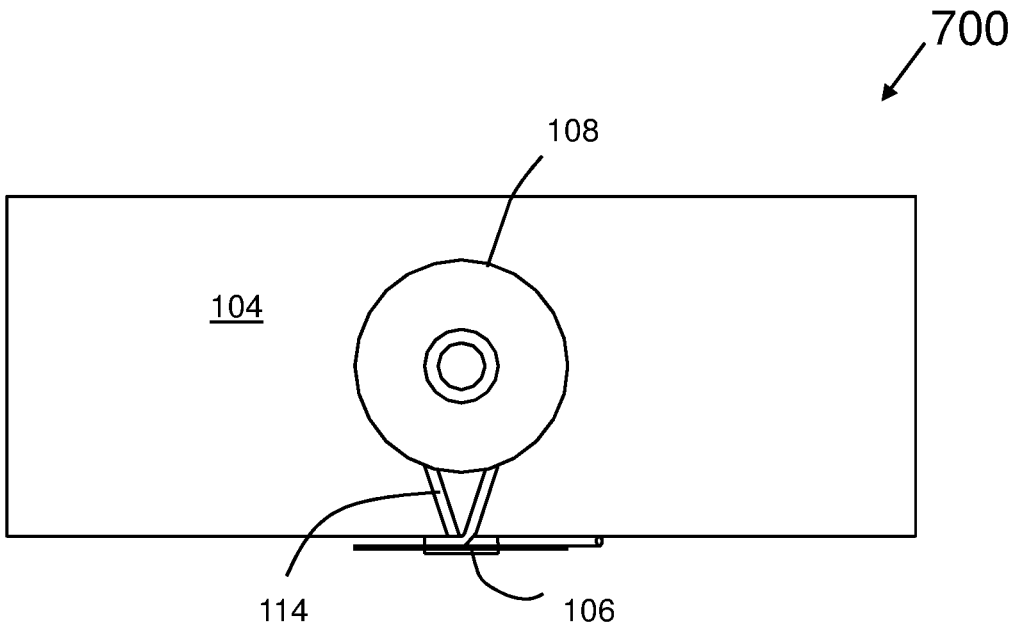
FIG. 7 is a schematic illustration of a top view of a cosmetic-product packaging such as the cosmetic-product of FIG. 1 in a closed state, in accordance with an embodiment of the present disclosure.

Referring to FIG. 7, there is shown a schematic illustration of a top view of a cosmetic-product packaging (such as the cosmetic-product packaging 100 of FIG. 1) in a closed state, in accordance with an embodiment of the present disclosure. The lid 104 is shown covering the outer container. The cord 114 is wrapped the first stud 106 and the second stud 108 for closing the outer container (as shown in FIG. 1).

Figure 8A:
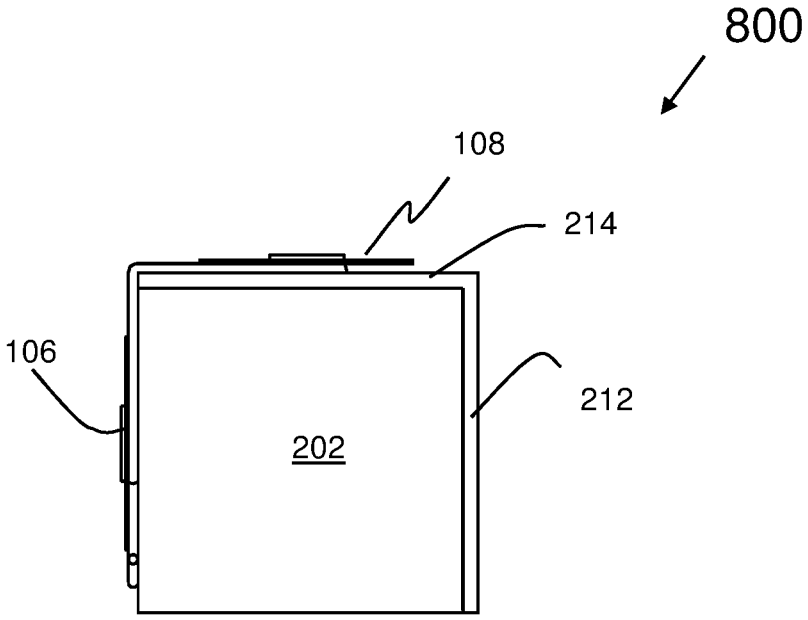
FIGS. 8A and 8B are schematic illustrations of a side view from respectively a first side and a second side of a cosmetic-product packaging such as the cosmetic-product of FIG. 1 in a closed state, in accordance with an embodiment of the present disclosure.
Figure 8B:
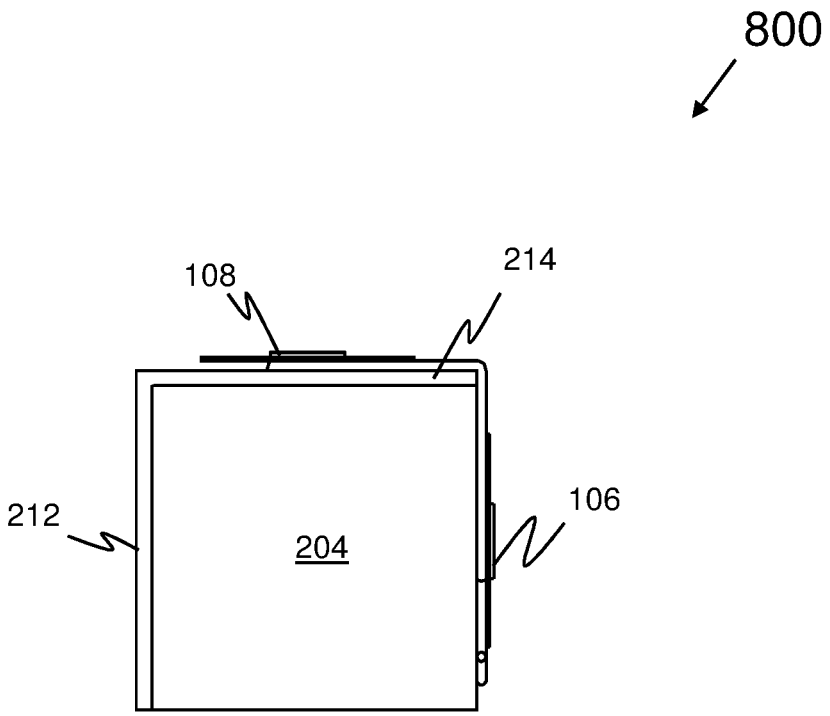

Referring to FIGS. 8A and 8B, there is shown a schematic illustration of a side view from respectively a first side and a second side of a cosmetic-product packaging (such as the cosmetic-product packaging 100 of FIG. 1) in a closed state, in accordance with an embodiment of the present disclosure. The first planar lid panel 212 is useable (namely is configured) to block access to the inner container (shown in FIG. 3).

In FIG. 8A, the side view of the cosmetic-product packaging is shown from the first side.

In FIG. 8B, the side view of the cosmetic-product packaging is shown from the second side.

Figure 9A:
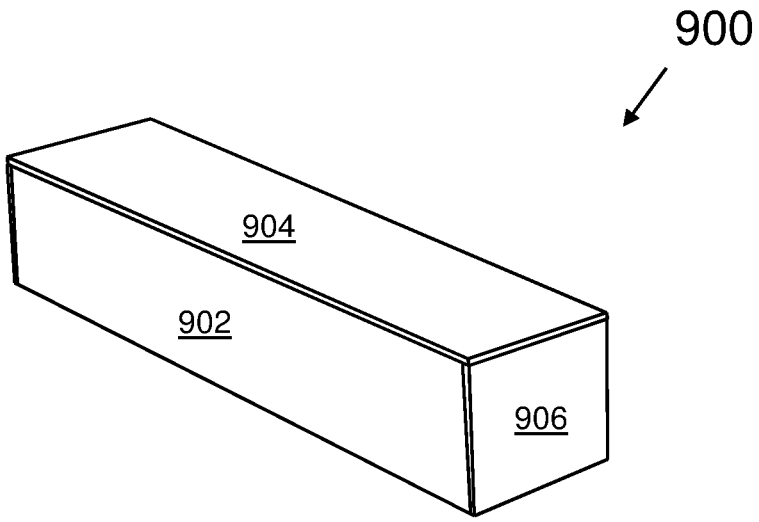
FIGS. 9A and 9B are schematic illustrations of an inner container such as the inner container of FIG. 3 in close and open state respectively, in accordance with an embodiment of the present disclosure.
Figure 9B:
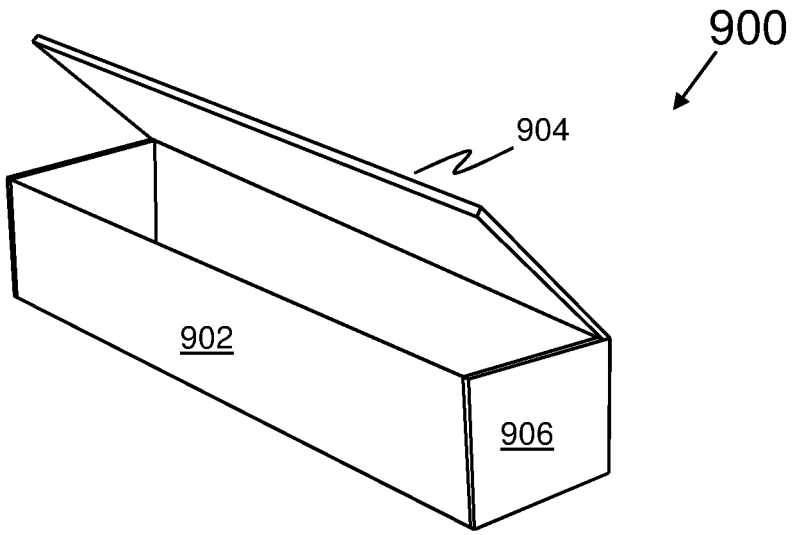

Referring to FIGS. 9A and 9B, there is shown a schematic illustration of an inner container (such as the inner container 302 of FIG. 3), in accordance with an embodiment of the present disclosure. The inner container has a plurality of planar panels, such as planar panels 902, 904 and 906.

In FIG. 9A, the inner container is shown in a closed state.

In FIG. 9B, the inner container is shown in an open state.

Modifications to embodiments of the present disclosure described in the foregoing are possible without departing from the scope of the present disclosure as defined by the accompanying claims. Expressions such as "including", "comprising", "incorporating", "have", "is" used to describe and claim the present disclosure are intended to be construed in a non-exclusive manner, namely allowing for items, components or elements not explicitly described also to be present. Reference to the singular is also to be construed to relate to the plural.

The invention claimed is:

1. A cosmetic-product packaging, wherein the cosmetic-product packaging includes:

(i) an outer container, and a lid that is pivotally coupled to the outer container, wherein the outer container and the lid are provided with a first stud and a second stud respectively, wherein the first stud and the second stud are disposed in a central region of the outer container and the lid respectively to secure the lid in a closed position from the central region, wherein the first stud and the second stud are provided with respective flanges that are accessible externally to the cosmetic-product packaging, wherein a flexible cord is attached to at least one of the first stud and the second stud and is wrappable under one or more flanges of the first stud and the second stud to secure the lid in the closed position to the outer container, wherein the flexible cord is temporarily attached to at least one of the first stud and the second stud and is unwrappable from under one or more flanges of the first stud and the second stud to disentangle the first stud and the second stud, and wherein one or more external surfaces of the outer container and the lid have a wipe-clean surface coating, wherein the wipe-clean surface coating acts as a water-proof coating to allow for cleaning the one or more external surfaces of the outer container and the lid by wet cleaning techniques;

(ii) an inner container that is mountable within the outer container, wherein, the inner container is accommodated with at least one cosmetics product, and the inner container is accommodated within the outer container; and (iii) the inner container is user-accessible when the lid is in an open position, wherein the flexible cord is unwrapped, for accessing the at least one cosmetics product.

2. The cosmetic-product packaging of claim 1, wherein the outer container and inner container are fabricated from paper or cardboard-containing materials.

3. The cosmetic-product packaging of claim 1, wherein the outer container has an elongate rectilinear shape, wherein the outer container includes planar end panels at two ends of the outer container, and a plurality of planar side panels on sides of the outer container, and wherein the lid includes a plurality of planar lid panels that are mutually pivotally attached, wherein a first planar lid panel is pivotally attached along an elongate edge of one of the plurality of planar side panels of the outer container, and wherein a second planar lid panel is provided with the second stud, and one of the plurality of planar side panels of the outer container is provided with the first stud, such that the second planar lid panel is abutting in operation to at least one of the plurality of planar side panels of the outer container when the lid is in the closed position, and the first planar lid panel prevents access to the inner container when the lid is in the closed position.

4. The cosmetic-product packaging of claim 3, wherein the outer container has an elongate length in a range 5 cm to 20 cm along an elongate axis of the outer container, and a lateral width in a range of 1 cm to 4 cm in a lateral axis of the outer container, wherein the elongate axis is orthogonal to the lateral axis, and the flanges of the first and second studs have a diameter in a range of 10 mm to 25 mm.

5. The cosmetic-product packaging of claim 4, wherein the flanges are secured to the outer container and the lid by employing hollow metallic rivets with radially outwardly-directed end ridges that retain the flanges to the outer container and the lid.

6. The cosmetic-product packaging of claim 3, wherein the plurality of planar side panels, the planar end panels of the outer container and the lid are fabricated as multi-layer structures.

7. The cosmetic-product packaging of claim 3 wherein one or more of at least one of the plurality of planar side panels and the planar end panels of the outer container and the lid are secured by adhesive bonding.

8. The cosmetic-product packaging of claim 3, wherein the inner container is of a rectilinear shape with planar side panels that abut to the plurality of planar side panels of the outer container, when the inner container is accommodated within the outer container.

9. The cosmetic-product packaging of claim 8, wherein the plurality of planar side panels of the inner container completely surround the accommodated at least one cosmetic product when the inner container is accommodated within the outer container.

10. The cosmetic-product packaging of claim 3, wherein one or more of one or more surfaces of the plurality of planar side panels and the planar end panels of the outer container are provided with a finish onto which graphical images are susceptible to being printed.

11. The cosmetic-product packaging of claim 1, wherein the first stud and the second stud are disposed in a range of 40% to 60% along an elongate length of the outer container and the lid.

12. The cosmetic-product packaging of claim 1, wherein the inner container is fabricated from a porous material configured to absorb liquid spills or oozing from the at least one cosmetics product.

13. The cosmetic-product packaging of claim 1, wherein the inner container is fabricated from corrugated cardboard.

* * * * *